US006451247B1

(12) United States Patent
Mordue et al.

(10) Patent No.: US 6,451,247 B1
(45) Date of Patent: Sep. 17, 2002

(54) SHAFT AND POST ASSEMBLIES FOR MOLTEN METAL APPARATUS

(75) Inventors: George S. Mordue, Ravenna; Mark A. Bright, Maple Heights; Chris T. Vild, Cleveland Heights; Richard S. Henderson, Solon, all of OH (US)

(73) Assignee: Metaullics Systems Co., L.P., Solon, OH (US)

( * ) Notice: Subject to any disclaimer, the term of this patent is extended or adjusted under 35 U.S.C. 154(b) by 0 days.

(21) Appl. No.: 09/436,014

(22) Filed: Nov. 9, 1999

Related U.S. Application Data

(60) Provisional application No. 60/107,701, filed on Nov. 9, 1998.

(51) Int. Cl.[7] ..... C21C 5/42
(52) U.S. Cl. ..... 266/239; 428/472
(58) Field of Search ..... 266/44, 45, 239; 428/472

(56) References Cited

U.S. PATENT DOCUMENTS 3,280,904 A * 10/1966 Hings ..... 428/472
3,735,803 A * 5/1973 Arrington et al. ..... 164/281
3,776,660 A 12/1973 Anderson et al.
4,598,899 A 7/1986 Cooper
4,898,367 A 2/1990 Cooper
4,921,283 A * 5/1990 Schaffner et al. ..... 285/114
4,941,692 A * 7/1990 Schaffner et al. ..... 285/114
5,558,505 A 9/1996 Mordue et al.
5,944,496 A 8/1999 Cooper
6,051,183 A * 4/2000 Morando ..... 266/239

FOREIGN PATENT DOCUMENTS

EP 0 610 708 A1 8/1994
WO WO 98/25031 6/1998

* cited by examiner

*Primary Examiner*—Scott Kastler
(74) *Attorney, Agent, or Firm*—Fay, Sharpe, Fagan, Minnich & McKee, LLP

(57) ABSTRACT

An apparatus for moving a stream of molten metal comprising a pumping member, a housing at least partially enclosing the pumping member, a power device seated on a support, a shaft connecting the power device and the pumping member. At least one post is disposed between the support and the housing. The post includes an elongated rod surrounded by a heat resistant outer member. The rod includes a first end connected to the support and a second end secured within a cavity in the housing.

15 Claims, 9 Drawing Sheets

1
25
41
43
22
23
26
45
11
27
27
33
31
29
37
35
39
3

1
17
25
22
21
23
11
15
19
9
9
3
5
7
9
9
13

SHAFT AND POST ASSEMBLIES FOR MOLTEN METAL APPARATUS

This application claims benefit of provisional application No. 60/107,710 filed Nov. 9, 1998

BACKGROUND OF THE INVENTION

This invention relates to apparatus for degassing, submerging, agitating and pumping molten metal. Particularly, this invention relates to mechanical apparatus for moving or pumping molten metal such as aluminum, zinc or magnesium. More particularly, this invention is related to a drive for such apparatus in which a motor is positioned above a molten metal bath and rotates a vertical shaft. The lower end of the shaft drives an impeller or a rotor to impart motion to the molten metal. The invention finds similar application in the construction of the post which supports the motor.

In the processing of molten metals, it is often necessary to pump molten metal from one place to another. When it is desired to remove metal from a vessel, a so called transfer pump is used. When it is desired to circulate molten metal within a vessel, a so called circulation pump is used. When it is desired to purify molten metal disposed within a vessel, a so called gas injection pump is used. In each of these pumps, a rotatable impeller is submerged, typically within a pumping chamber, in the molten metal bath contained in the vessel. Additionally, the motor is suspended on a superstructure over the bath by posts connected to the base. Rotation of the impeller within the pumping chamber forces the molten metal as desired in a direction permitted by the pumping chamber design. The present invention relates to an improved design for each of these types of pumps.

Mechanical pumps for moving molten metal in a bath historically have a relatively short life because of the destructive effects of the molten metal environment on the material used to construct the pump. Moreover, most materials capable of long term operation in a molten metal bath have relatively poor strength which can result in mechanical failure. In this regard, the industry has typically relied on graphite, a material with adequate strength, temperature resistance and chemical resistance, to function for an acceptable period of time in the harsh molten metal environment.

While graphite is currently the most commonly used material, it presents certain difficulties to pump manufacturers. Particularly, mechanical pumps usually require a graphite pump housing submerged in the molten metal. However, the housing is somewhat buoyant in the metal bath because the graphite has a lower density than the metal. In order to prevent the pump housing from rising in the metal and to prevent unwanted lateral movement of the base, a series of vertical legs are positioned between the pump housing and an overhead structure which acts simultaneously to support the drive motor and locate the base. In addition to functioning as the intermediate member in the above roles, the legs, or posts as they are also called, must be strong enough to withstand the tensile stress created during installation and removal of the pump in the molten metal bath.

Similarly, the shaft connecting the impeller and the motor is constructed of graphite. Often, this shaft component experiences significant stress when occluding matter in the metal bath is encountered and sometimes trapped against the housing. Since graphite does not possess as high a strength as would be desired, it would be helpful to reinforce the leg and shaft components of the pump.

In addition, graphite can be difficult to work with because different stock may have different thermal expansion rates and/or different grain orientation. This may result in a post and base having divergent and conflicting thermal expansion rates in the molten metal environment. This problem is compounded by the fact that pump construction has historically required cementing the graphite post into a hole in the graphite base. This design provides no tolerance between the components to accommodate divergent thermal expansion. Unfortunately, this can lead to cracking of the base or the post. Accordingly, it would be desirable to have a molten metal pump wherein the mating of a post and a base is achieved in a manner which accommodates divergent thermal expansion tendencies.

The present invention is equally applicable to a variety of other apparatus used in processing molten metal. Moreover, in addition to pumps, molten metal scrap melting (i.e. submergence), degassing, and agitation equipment, typically rely on the rotation of an impeller/rotor submerged by a vertical shaft in a bath of molten metal. More specifically, a submergence device is used to help melt recycle materials. A major concern of the secondary metal industry is a generation of oxides and gasses which become entrained or dissolved into the molten metal during the melting of scrap metal. These impurities decrease the quality and value of the scrap metal which is ultimately marketable as end product. Accordingly, a degassing device is often used to remove these impurities. In the degasser, a hollow shaft is typically provided to facilitate the injection of gas down the shaft and out through the bores in an impeller/shaft rotor. Typically, the introduced gasses will chemically release the unwanted materials to form a precipitate or dross that can be separated from the remainder of the molten metal bath.

An example of a submergence device is described in U.S. Pat. No. 4,598,899, herein incorporated by reference. An exemplary degassing apparatus is described in U.S. Pat. No. 4,898,367, herein incorporated by reference. In both devices, a vertically oriented shaft having a impeller/rotor disposed at one end in the molten metal bath is employed. Similar problems arise in these apparatus wherein the components are usually constructed of graphite, and would benefit from an increase in strength.

SUMMARY OF THE INVENTION

Accordingly, it is a primary advantage of this invention to provide a new and improved molten metal pump.

It is a further advantage of this invention is to provide a new and improved post for a molten metal pump.

Another advantage of this invention is to provide a new and improved shaft for a molten metal pump, degasser or submergence device.

Yet another advantage of the subject invention is to provide a new and improved mechanism for joining of a pump post to a pump base.

A still further advantage of this invention is to provide a molten metal pump post or shaft having improved strength.

Another advantage of this invention is to provide a self-aligning post without a requirement for a cement joint.

Additional advantages of the invention will be set forth in part in the description which follows and in part will be obvious from the description, or may be learned by practicing the invention. The advantages of this invention may be realized and attained by means of the instrumentalities and combinations particularly pointed out in the appended claims.

To achieve the foregoing advantages in accordance with the purpose of the invention, as embodied and broadly described herein, the molten metal pump of this invention comprises a pumping member (such as an impeller or rotor), at least partially enclosed within a housing. A power device is seated on a support above the housing and pumping member. A shaft connects the power device and the pumping member to provide rotation thereof. At least one, and preferably two to four posts, suspend the housing from the support. One or both of the post or shaft is comprised of an elongated rod surrounded by a heat resistant outer member. In the post embodiment, the rod includes a first end attached to the support (directly or via a coupling) and a second end disposed within a cavity in the housing. Alternatively, the rod can be used strictly for compressing the outer member, which is coupled to the support. In the shaft embodiment, the rod includes a first end secured to the power device (directly or via a coupling) and a second end disposed within a cavity in the pumping member. It is also noted that the shaft embodiment is further suited to use in submergence, degassing and agitation devices.

Preferably, the outer member is comprised of a graphite, refractory, or ceramic material and the housing is comprised of graphite. Preferably, the rod will be comprised of a heat resistant alloy.

In a particularly preferred form of the post embodiment, the rod is biased by a spring. Preferably, the outer member abuts a bottom surface of the support (or an intermediate coupling) and a top surface of the housing and the biasing force of the spring creates a compressive force on the outer member.

In a particularly preferred form of the invention, the outer member is comprised of a plurality of generally cylindrically shaped units, aligned along their longitudinal axis. The rod runs down a central bore of each unit to provide a stacked arrangement. Preferably, the lower most unit will include a circumferential protrusion shaped to mate with a recess formed in the top surface of the housing to create a fluid tight seal.

BRIEF DESCRIPTION OF THE DRAWINGS

The invention consists in the novel parts, construction, arrangements, combinations and improvements shown and described. The accompanying drawings, which are incorporated in and constitute a part of the specification illustrate one embodiment in the invention and, together with the description, serve to explain the principles of the invention. Of the Drawings.

DETAILED DESCRIPTION OF THE INVENTION

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications and equivalents as may be included within the spirit and scope of the invention defined by the appended claims.

Figures 1, 2:
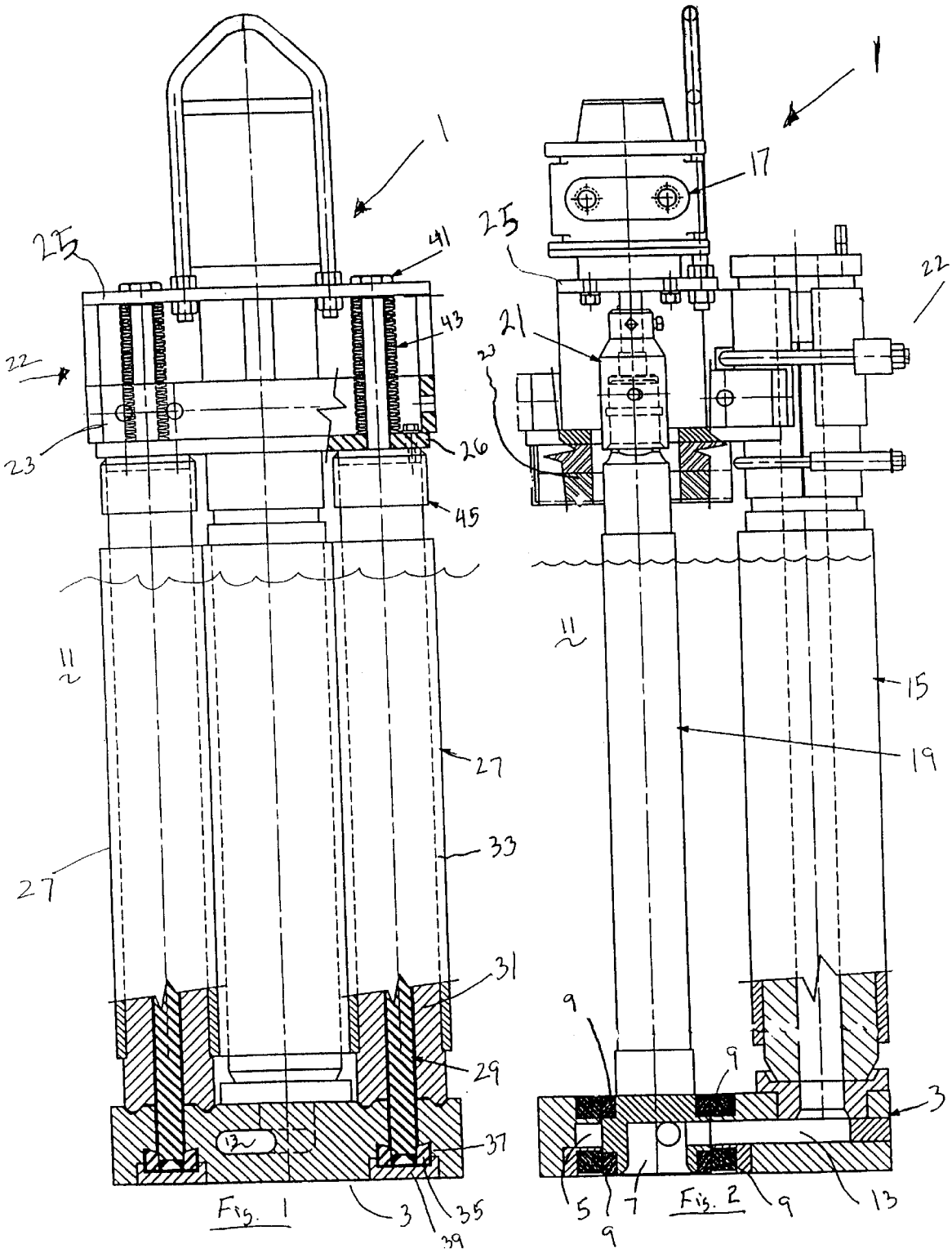
FIG. 1 is a front elevation view, partially in cross-section, of a molten metal pump in accord with the present invention.
FIG. 2 is a side elevation view, also partially in cross-section, of FIG. 1.

Referring now to FIGS. 1 and 2, molten metal transfer pump 1 is provided. The molten metal pump includes a base assembly 3 having a pumping chamber 5 with an impeller 7 disposed therein. Bearing rings 9 provide mating surfaces between the impeller 7 and the base assembly 3. Rotation of the impeller 7 forces molten metal 11 through outlet 13 and up riser tube 15 for transport to another location.

Rotation of impeller 7 is achieved when motor 17 rotates shaft 19 by turning shaft coupling 21 provided therebetween. The motor is positioned above the base assembly 3 on a platform assembly 22 having an insulation layer 23, a motor mount bracket 25 and a motor mount plate 26.

Two post assemblies 27, comprised of a rod 29 constructed of a heat resistant alloy material disposed within a refractory sheath 31 suspend the base assembly 3 below the platform 22. Preferably, the rod will be constructed of an alloy such as MSA 2000 or MSA 20001 available from Metaullics Systems Co., L.P., 31935 Aurora Road, Solon, Ohio, 44139. The refractory sheath also includes a ceramic shield 33 for additional protection against oxidation. The lower end of rod 19 includes cap 35. Cap 35 is disposed within a cavity 37 in base assembly 3. A graphite or refractory plug 39 is cemented into the lowermost portion of the cavity to seal the area from molten metal. The upper end of the rod 29 extends through the insulation layer 23 and is secured with nut 41 to the motor mount plate 26. A disc spring 43 or other compression spring is disposed between the motor mount platform 25 and insulation layer 23. Preferably, an insulating washer (not shown) will be positioned between motor mount plate 26 and spring 43. Tightening of nut 41 results in compression of the spring 43 and a bias on the rod 29 and sheath 31.

Advantageously this assembly provides a high strength alloy rod connection between the base and motor mount. Of course, it also protects the otherwise degradable rod from the molten metal environment. A further advantage is that the thermal expansion mismatch resulting from divergent grain orientations in a graphite post and a graphite base is eliminated because a graphite post is not rigidly cemented into a hole in the base. Furthermore, the strength of the graphite sheath is increased because it is retained under compression as a result of being squeezed between a socket 45 and the upper surface of base assembly 3.

Figure 4:
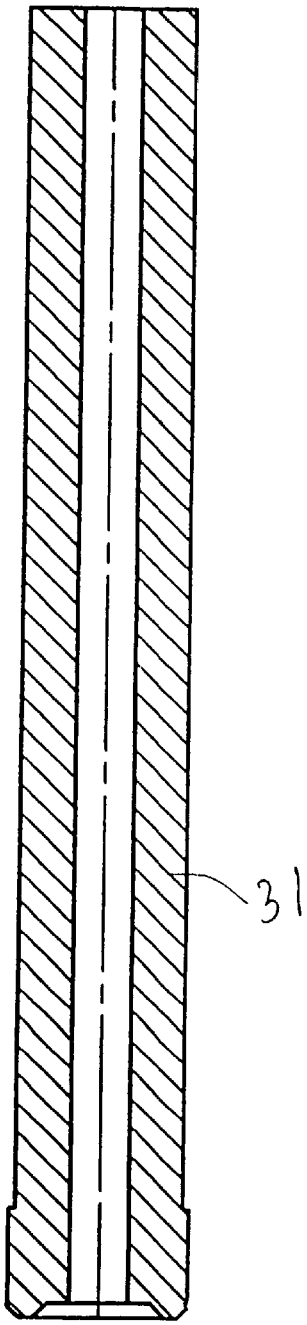
FIG. 4 is a front elevation view, in cross-section, of the inventive sheath of FIG. 1.
Figure 3:
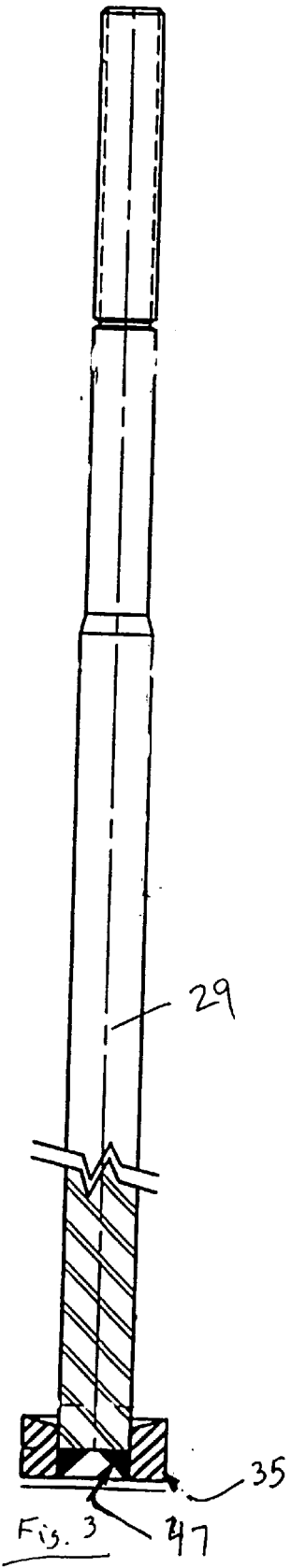
FIG. 3 is a front elevation view, partially in cross-section, of the rod of FIG. 1.

Turning now to FIG. 3, a detailed depiction of rod 29 is provided. In this embodiment, cap member 35 is welded at weld lines 47 to the lower most end of the rod. Of course, other mechanisms of attachment, including but not limited to, threaded or swaged, are appropriate joining techniques. FIG. 4 provides a detailed cross-sectional view of the graphite sheath 31.

Figure 5:
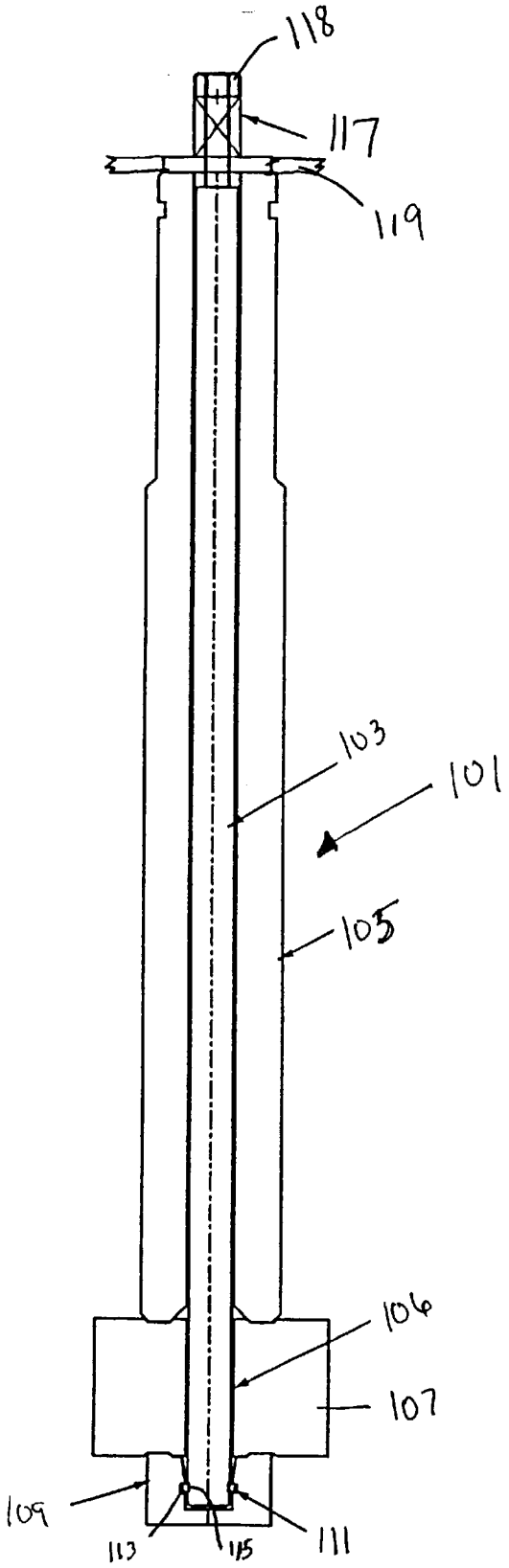
FIG. 5 is a front elevation view, in cross-section, of an alternative post embodiment.

Referring now to FIG. 5, an alternative post embodiment is depicted. In this embodiment, the post 101 again includes rod 103 protected from the molten metal environment by sheath 105. Rod 103 passes through a bore/cavity 106 in a base member 107 and is retained by the cap 109 containing a snap ring 111 having corresponding retaining grooves 113 and 115 in the cap 109 and rod 103, respectively. Again a disk spring 117 and nut 118 are provided, which in concert with the platform 119 create a bias on rod 103 and a compressive force on sheath 105.

Figure 6:
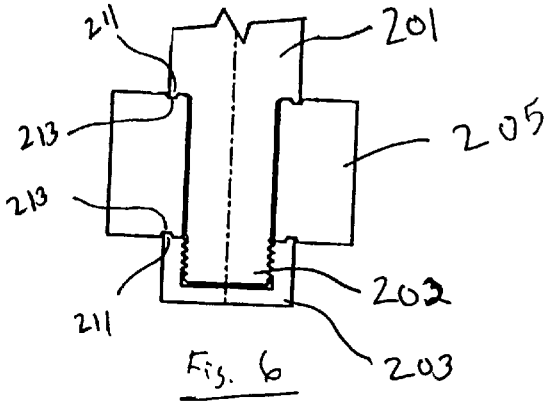
FIGS. 6, 7 and 8 are front elevation views, in cross-section, of alternative post and base seating arrangements.
Figure 7:
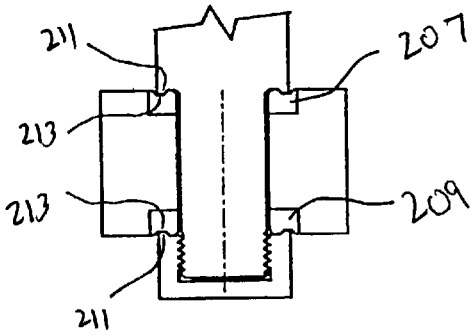
Figure 8:
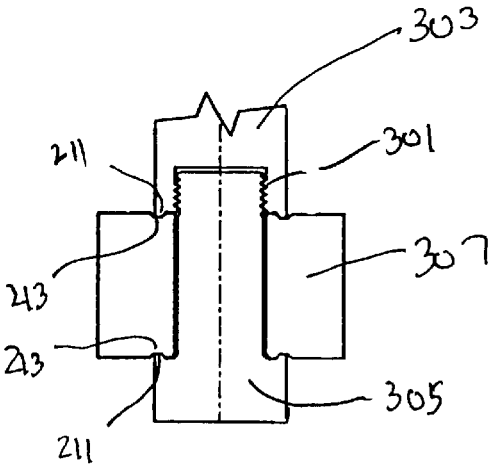

Turning now to FIGS. 6, 7, and 8, alterative post and base joining techniques are depicted. For example, in FIG. 6, rod 201 extends through base 205 and includes a threaded end 202 on which graphite cap 203 is secured. In FIG. 7, the embodiment of FIG. 6 is modified to include seal members 207 and 209 constructed of boron nitride, silicon carbide, or other suitable material. In FIG. 8, an alternative embodiment is depicted wherein a threaded bore 301 is provided in the end of graphite post 303 and a threaded graphite post 305 extends upwardly through base member 307 and is mated to the end of the post 303. An advantage of each design is the ability to create a tension on the post to provide a self-alignment mechanism without the need for a structural use of cement. In this regard, a thermal expansion gap can be provided (see FIG. 11) where cement has been historically required.

Furthermore, the use of a protrusion 211 on the end cap post/bolt 203/205 in a combination with recesses 213 on the top and bottom surfaces of the base 205/307 create a fluid tight joint. Accordingly, molten metal does not enter this joint, allowing the post to be removed from the base if a rebuild of the pump is required.

It should be noted that while the present joining mechanisms in FIGS. 6 through 8 are generally depicted as coinciding to the utilization of a steel alloy rod, these mechanisms for joining a post to a base are equally applicable to a graphite post arrangement. Moreover, the arrangements depicted in FIGS. 6 through 8 can equally be considered as being constructed of all elements comprised of a combination of steel and graphite/ceramic or graphite/ceramic alone. The advantage provided by these assemblies is that there is no necessity for a cement joint between the post and the base which better accommodates thermal expansion mismatches.

Figure 9:
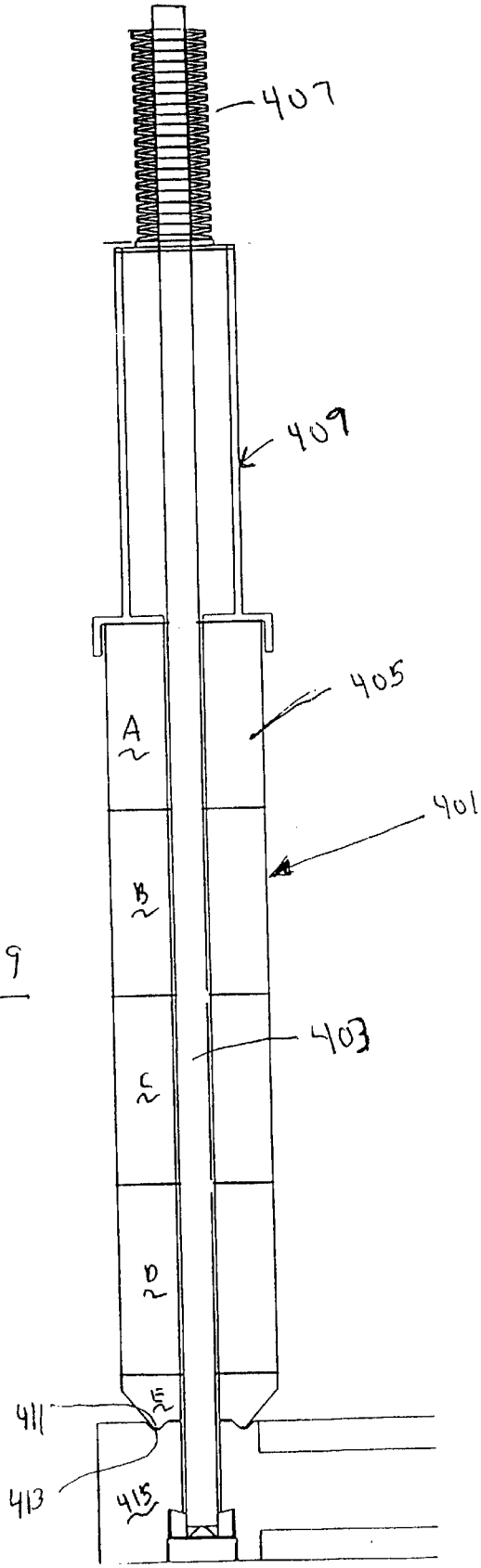
FIG. 9 is a front elevation view, in cross-section, of a segmented post design.

Turning now to FIG. 9, an alternative embodiment of the present invention is provided wherein the post 401 includes a rod 403 and a sheath 405. However, in this embodiment sheath 405 is comprised of the plurality of segmented units. This design is particularly desirable because of the relative ease of forming individual segmented units (A–E) as opposed to an elongated tube. Again, the post 401 is provided with a spring 407 and a metallic coupling unit 409, which in combination with the motor mount (not shown) creates a compressive force on the sheath segments (A–E). A fluid tight seal is created between each of the individual units as a result of the compressive force, and, may be enhanced by the inclusion of a gasket material (not shown) therebetween. The lower most unit E includes a circumferential protrusion 411 which is seated in a recess 413 in the top surface of the base 415. Accordingly, a fluid tight seal is achieved. As in any of the other designs herein, a bead of cement or sealant may be placed around the seated protrusion 411 to further protect against unwanted metal seepage.

Figure 10:
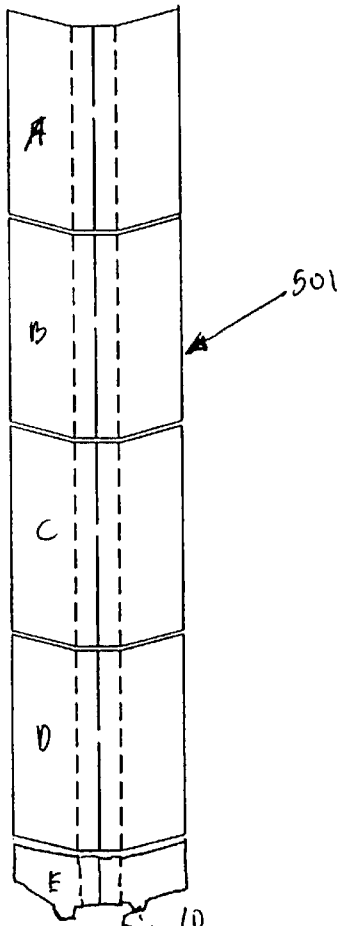
FIG. 10 is a front elevation view, in cross-section, of an alternative segmented sheath design.

Referring now to FIG. 10, an alternative embodiment of a segmented sheath 501 is depicted. In this embodiment, the end surfaces of the individual units A–E are cooperatively contoured to facilitate achieving an appropriate mating arrangement. In this regard, a verifiable seating arrangement is provided to assure a metal tight seal is formed between each individual segment.

Figure 11:
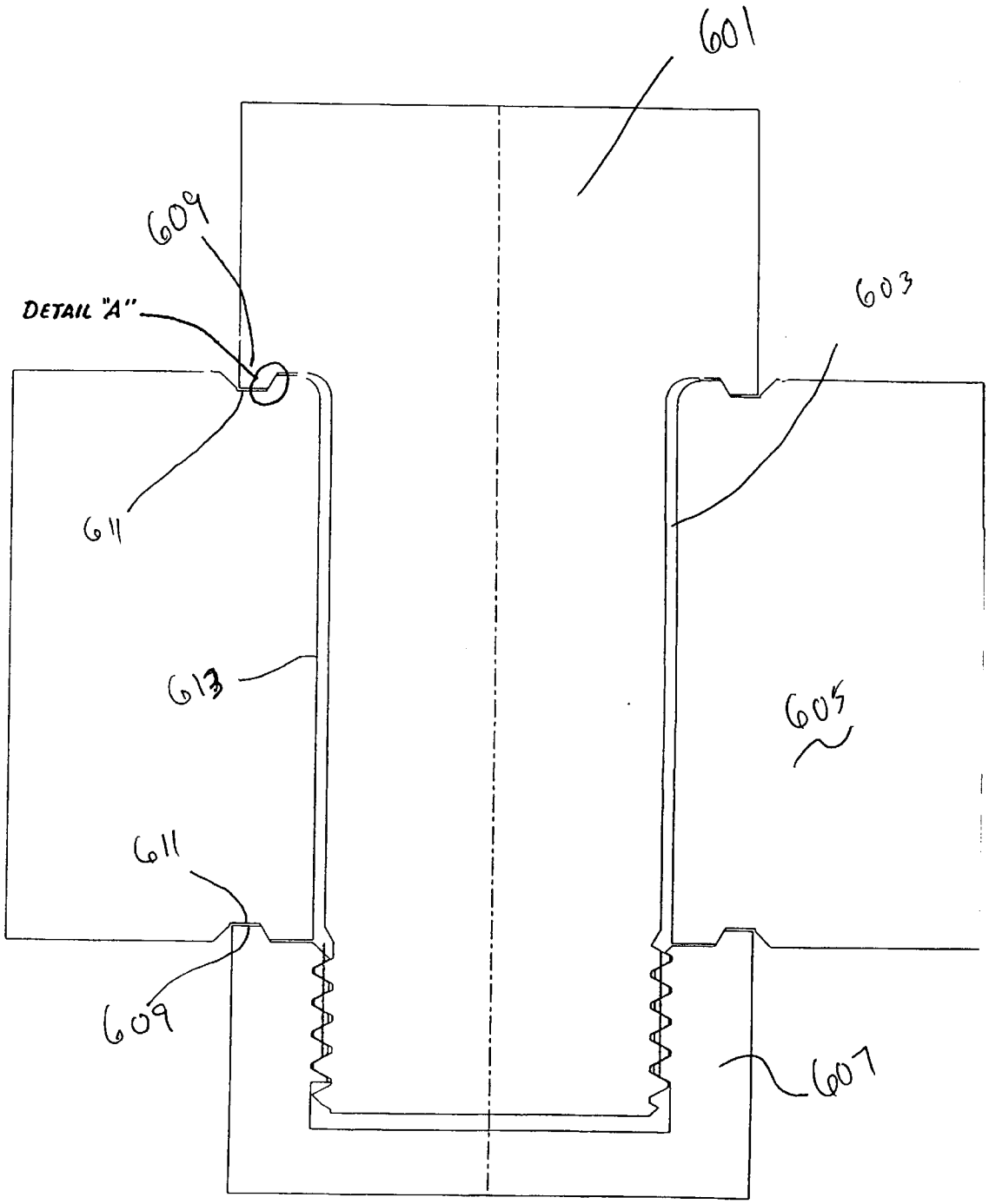
FIG. 11 is an exploded side elevation view, in cross-section, of an alternative post/base joining arrangement.
Figure 12:
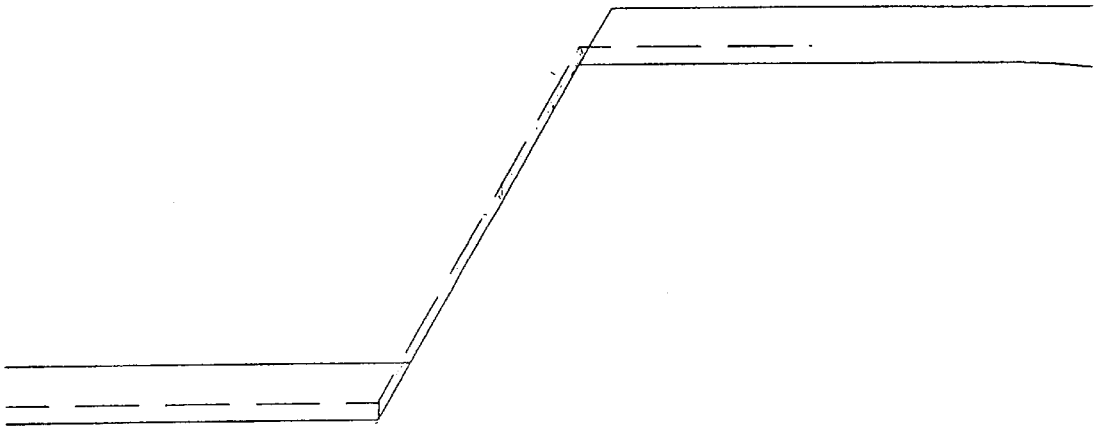
FIG. 12 is an exploded view of section A of FIG. 11 showing the fluid tight joint.
Figure 13:
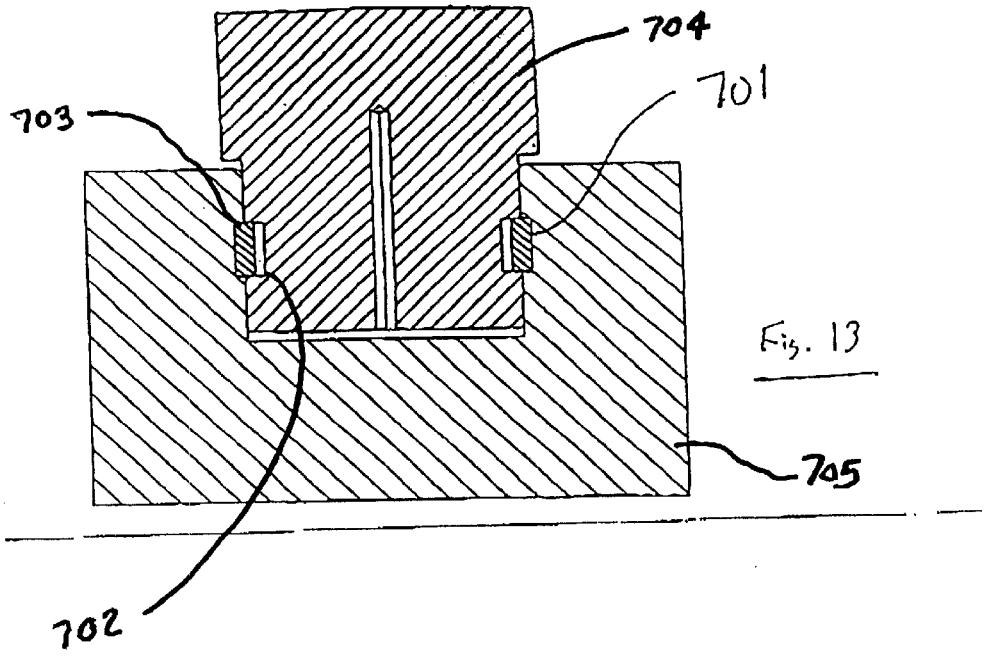
FIGS. 13 and 14 provide alternative base and post joining mechanisms.

Turning now to FIG. 11, a detailed view of an arrangement mating a graphite post to a graphite base is provided to demonstrate both the desired tolerance for thermal expansion and a desirable configuration for achieving a fluid tight seal. More particularly, graphite post 601 passes through a hole 603 in a base assembly 605. Threaded graphite cap member 607 is attached to the lowermost portion of post 601. At both of the top and bottom interface of post 601 and/or cap member 607 to the base assembly 605, a cooperative protrusion 609 and recess 611 are provided to create a fluid tight if seal. Referring now to FIG. 12, the angled surfaces of the protrusion and recess are depicted. In this manner, a fluid tight mating surface achieved. The mating surfaces may be filled with a gasket material (not shown). A further advantage of the present invention is the tolerance provided by gap 613 for thermal expansion.

Referring now to FIGS. 13–16, alternative embodiments for securing a graphite shaft to a graphite base without cement are provided. Particularly, in FIG. 13, snap ring 701 is provided which is joined between corresponding grooves 702 and 703 and post 704 and base 705 respectively.

Figure 14:
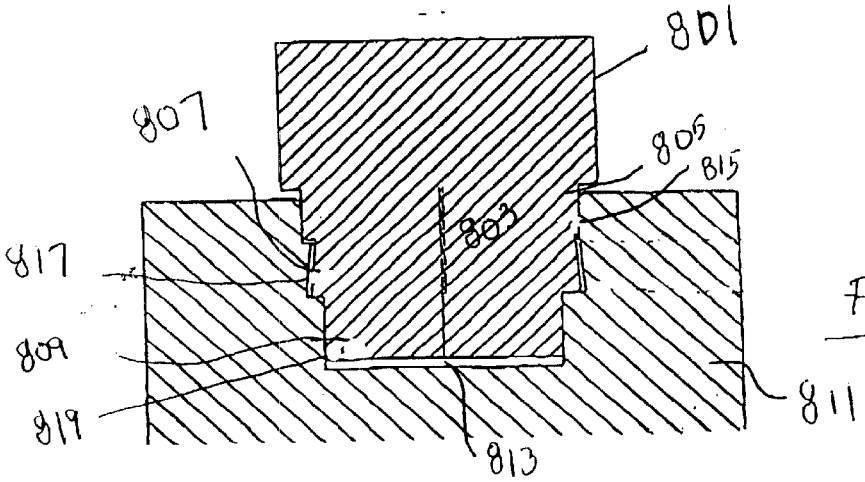
Figures 15, 16:
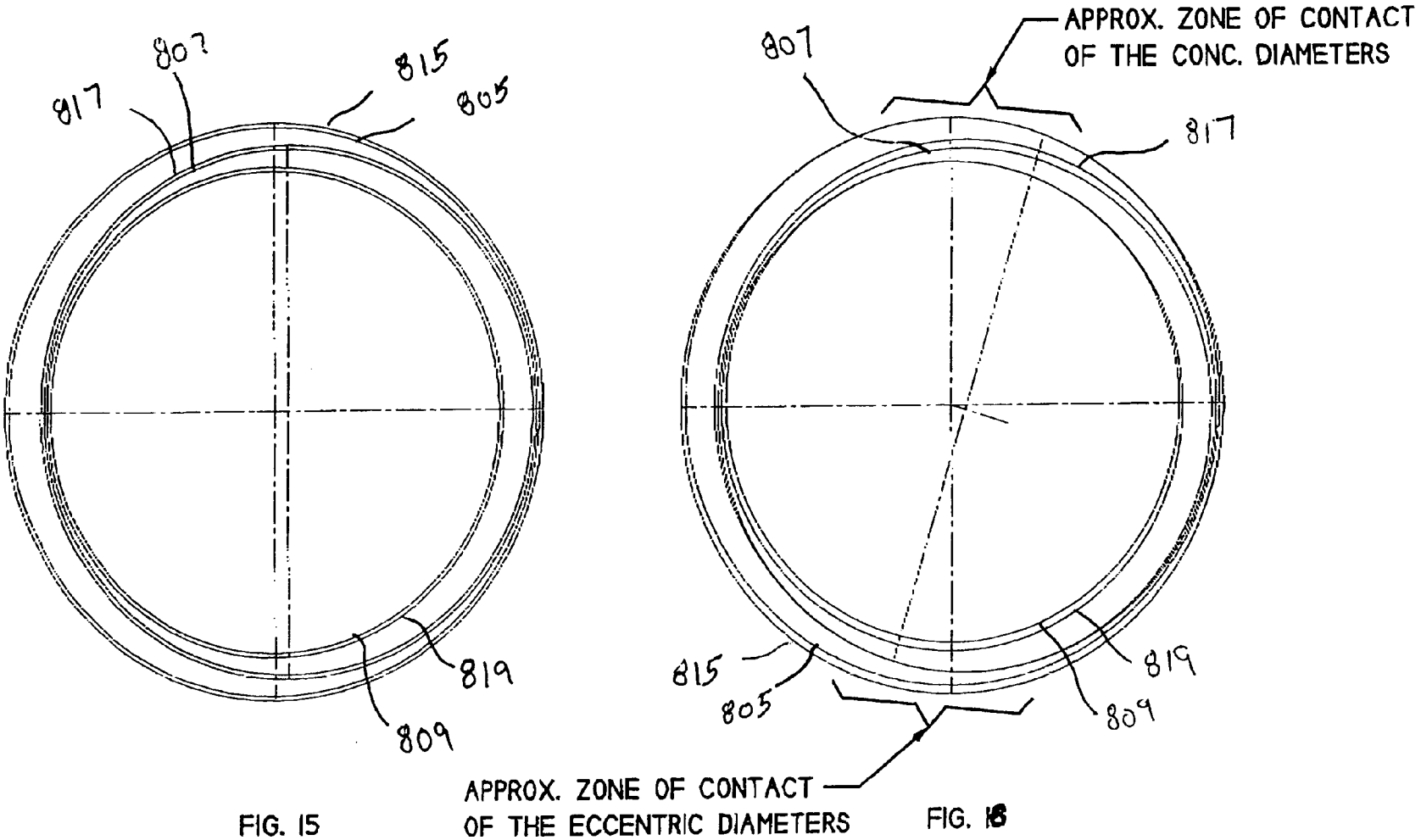
FIG. 15 is a top view of the base and post of FIG. 14 with their eccentric diameters aligned to allow insertion of post into base.
FIG. 16 is a top view of the base and post of FIGS. 14 and 15 with the post rotated to misaligned diameters to achieve a locking arrangement.

FIGS. 14, 15 and 16 depict a cam type locking mechanism which with post rotated (clockwise in this example) relative to the base until their relative eccentric diameters touch and displace the post slightly until any clearance between the previously concentric diameters is eliminated. This creates an efficient wedging together of the parts securing the post to the base. More specifically, post 801 is provided with a stepped end 803 having three different diameter sections 805, 807 and 809. Base 811 includes a bore 813 which accommodates end 803 of post 801. Base 813 includes three different diameter regions 815, 817 and 819. Section 807 and region 817 are eccentric relative to corresponding sections 805 and 809 and regions 815 and 819, respectively. In this manner, rotation of post 801 results in a wedging (see FIG. 16) of the respective sections and regions and an effective mating of the post 801 to base 811. It should also be noted that this cam locking mechanism is equally suited to a shaft impeller assembly.

Figure 17:
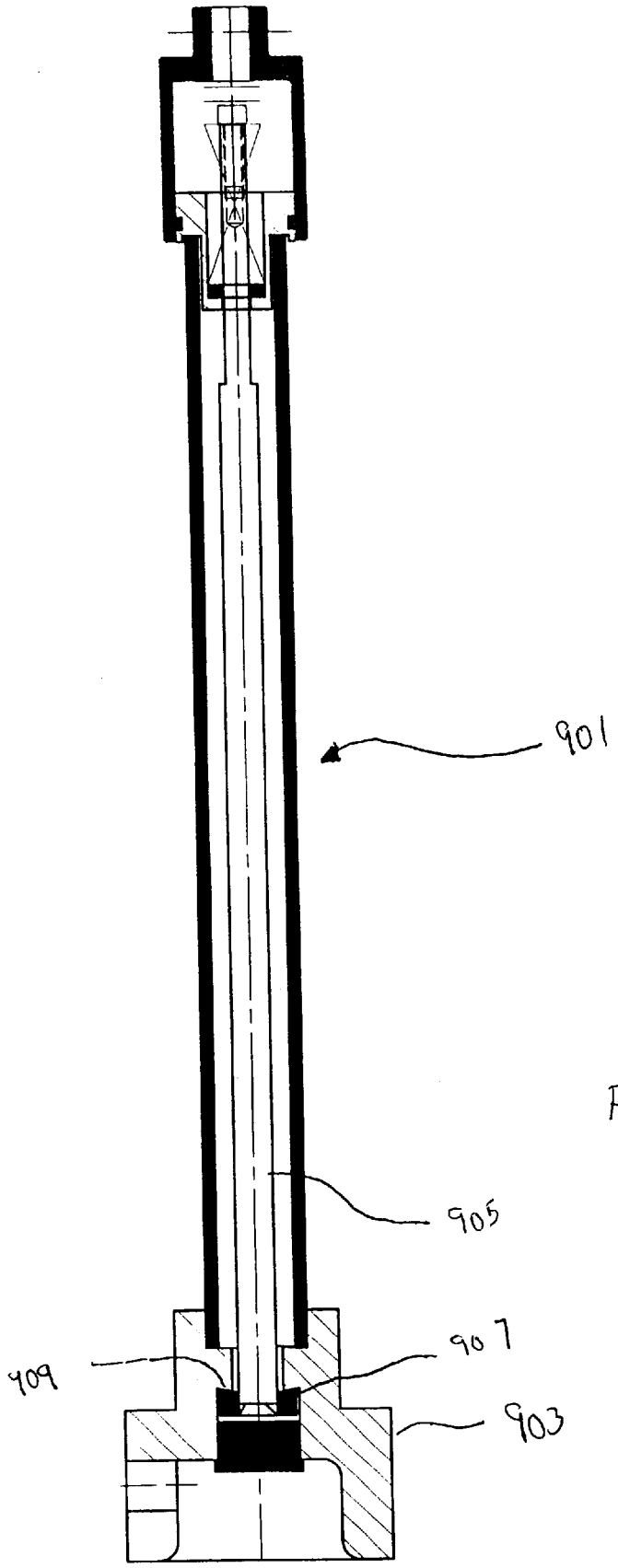
FIG. 17 is a front elevation view, partially in cross-section, of a shaft impeller arrangement of the present invention.

Referring now to FIG. 17, a shaft to impeller/rotor arrangement 901 is depicted. In short, the same design using a rod and sheath as shown and discussed with respect to FIG. 1 is employed. Particularly, an impeller 903 is secured to a rod 905. Rod 905 includes cup 907 at a lower end, cap 907 being disposed within a recess 909 in impeller 903. Preferably, cap 907 will include a jagged top surface (not shown) which mates with peaks and valleys (not shown) in the upper surface of recess 909. This embodiment is suited to degassing, agitation, pumping and submergence apparatus. It should be noted that the degassing embodiment would most likely include a bore through the rod—or a sufficient gap between sheath and rod—to facilitate introduction of a reaction gas or other suitable agent.

Thus, it is apparent that there has been provided in accordance with the invention, a molten metal pump that fully satisfies the objects, aims, and advantages set forth above. While the invention has been described in conjunction with specific embodiments thereof, it is evident that many alternatives, modifications and variations will be apparent to those skilled in the art like of the foregoing description. Accordingly, it is intended to embrace all such alternatives, modifications and variations as fall within the spirit and broad scope of the appended claims.

What is claimed is:

1. An apparatus for moving a stream of molten metal comprising:

a rotatable pumping member;

a housing at least partially enclosing the pumping member;

a power device seated on a support;

a shaft connecting the power device and the pumping member; and at least one post disposed between said support and said housing, said post comprising an elongated alloy rod surrounded by a heat resistant outer member, said rod having a first end connected to said support and a second end including a shoulder secured within a cavity in said housing.

2. The apparatus of claim 1 wherein said outer member is comprised of a graphite, refractory or ceramic material.

3. The apparatus of claim 1 wherein said rod is comprised of a heat resistant alloy.

4. The apparatus of claim 1 wherein said housing includes a recess in a top surface which mates with a protrusion on the outer member.

5. The apparatus of claim 1 wherein said housing includes a recess in a top surface which accommodates a lower end of said outer member.

6. The apparatus of claim 1 wherein a spring is a component connecting said rod to said support to provide a bias on said post.

7. The apparatus of claim 6 wherein a metal sleeve is disposed between said outer member and said support.

8. The apparatus of claim 1 wherein said outer member is comprised of multiple segments.

9. The apparatus of claim 1 wherein said cavity extends the height of said housing and includes a top opening accommodating said rod but narrower than said shoulder and a bottom opening accommodating said shoulder.

10. The apparatus of claim 9 wherein a graphite, refractory or ceramic plug is inserted into said bottom opening.

11. An apparatus for moving a stream of molten metal comprising:

a rotatable pumping member;

a housing at least partially enclosing the pumping member, a power device seated on a support;

a shaft connecting the power device and the pumping member; and at least one post disposed between said support and said housing, said post comprising an elongated alloy rod surrounded by a heat resistant outer member, said rod having a first end connected to said support and a second end secured within a cavity in said housing, wherein said second end of said rod extends partially through said cavity and is threadedly attached to a graphite, refractory or ceramic cap to secure said post to said housing.

12. The apparatus of claim 8 wherein a lowermost segment includes a protrusion mating with a recess in a top surface of said housing.

13. The apparatus of claim 4 wherein said recess includes an outer wall having an obtuse angle and said protrusion includes a similarly angled outer wall.

14. A molten metal post comprised of an elongated graphite, refractory or ceramic member including an end having multiple, axially non-aligned, circular sections formed to create a cam lock arrangement within a bore of a housing.

15. A molten metal shaft and impeller combination, said shaft comprising a cylindrical body having an end with a plurality of axially, non-aligned circular sections, said circular sections wedged into a plurality of connecting circular bore openings in said impeller.

* * * * *